US006392611B1

(12) United States Patent
Smith et al.

(10) Patent No.: US 6,392,611 B1
(45) Date of Patent: May 21, 2002

(54) ARRAY FED MULTIPLE BEAM ARRAY REFLECTOR ANTENNA SYSTEMS AND METHOD

(75) Inventors: Terry M. Smith, La Honda; George Hardie, Santa Barbara; Douglas G. Burr, San Jose, all of CA (US)

(73) Assignee: Space Systems/Loral, Inc., Palo Alto, CA (US)

( * ) Notice: Subject to any disclaimer, the term of this patent is extended or adjusted under 35 U.S.C. 154(b) by 0 days.

(21) Appl. No.: 09/640,936

(22) Filed: Aug. 17, 2000

(51) Int. Cl.[7] ..... H01Q 15/14; H01Q 13/00

(52) U.S. Cl. ..... 343/912; 343/756; 343/779; 343/840

(58) Field of Search ..... 343/779, 781 R, 343/781 CA, 781 P, 786, 840, 771, 756, 909, DIG. 2

(56) References Cited

U.S. PATENT DOCUMENTS 4,090,203 A * 5/1978 Duncan ..... 343/753
4,343,005 A * 8/1982 Han et al. ..... 343/781 P
4,364,052 A * 12/1982 Ohm ..... 343/781 P
4,618,866 A * 10/1986 Makino et al. ..... 343/779
4,811,029 A * 3/1989 Nomoto et al. ..... 343/779
5,517,203 A * 5/1996 Fiedziuszko ..... 343/756
5,949,387 A * 9/1999 Wu et al. ..... 343/909
6,211,838 B1 * 4/2001 Cherrette et al. ..... 343/786
6,271,799 B1 * 8/2001 Rief et al. ..... 343/776

* cited by examiner

*Primary Examiner*—Tan Ho
(74) *Attorney, Agent, or Firm*—Kenneth W. Float

(57) ABSTRACT

Array fed multiple beam antenna systems and methods for use on an orbiting spacecraft carrying a communication system. The antenna systems include a reflector and a relatively small array feed compared to the reflector. The array feed has feeds (radiators) that illuminate the reflector and that are disposed in a focal plane of the reflector. A power division network excites the radiators of the feeds. The antenna system is capable of very wide scan angle operation and may be used to provide multiple spot beam coverage over the surface of the Earth viewed from a synchronous orbit spacecraft. Phase aberration normally associated with scanning is corrected by adjusting excitation coefficients of each array feed. The spot beams are scanned across a field of regard by controlling the position of each feed in the focal plane and using the appropriate amplitude and phase distribution associated with a particular spot beam (array feed). The amplitude and phase distributions may be fixed or varied during operation. A dual band system includes a second array feed and a frequency selective surface disposed between the array feeds that optimizes the respective array feeds. Use of the frequency selective surface in dual band implementations produces a very efficient communication system.

18 Claims, 4 Drawing Sheets

ARRAY FED MULTIPLE BEAM ARRAY REFLECTOR ANTENNA SYSTEMS AND METHOD

BACKGROUND

The present invention relates generally to spacecraft communication systems and methods, and more particularly, to array fed multiple beam antenna systems and methods for use in spacecraft communication systems.

The assignee of the present invention manufactures and deploys communication satellites. In order to provide desired coverage of a particular area on the Earth, and maximize re-use of the allocated frequency spectrum, it is necessary to use a multiple beam antenna system.

Conventional multiple beam antenna systems that provide contiguous coverage of a desired region, typically localize antenna beams on a two dimensional triangular or rectangular lattice. Conventional reflector or lens multiple beam antenna systems generally require the use of three or four apertures to efficiently achieve the desired coverage. Furthermore, the bandwidth for each beam produced by conventional multiple beam antennas and useable in a frequency re-use plan is generally less that would be desired.

Previous designs for multiple beam antennas use a single horn radiator for each feed in the antenna. The single feed radiator design used in previous multiple beam antenna designs was a compromise that minimized the worst case scan beam degradation. This caused either poor performance for the beams close to focus, or poor performance for the scan beams.

The previous designs thus suffered from the effect of scan aberration that could not be corrected by modifying the field distribution in the focal plane of the antenna. These designs are well known and published extensively throughout the literature relating to antenna design. The present invention avoids this compromise by allowing different feed radiator characteristics to be used for different beam positions.

It would be desirable to have a multiple beam antenna system and communication methods for use with a communications satellite. It would also be desirable to have a multiple beam antenna system for use with a communications satellite that allows different feed radiator characteristics to be used for different beam positions. It is therefore an objective of the present invention to provide for array fed multiple beam antenna systems and methods for use in satellite communication systems.

SUMMARY OF THE INVENTION

To accomplish the above and other objectives, the present invention provides for array fed multiple beam antenna systems and methods that improve upon conventional multibeam antenna systems and beam generation methods. An exemplary system is employed in a communications system disposed on a spacecraft and comprises a reflector and an array feed, such as a waveguide slot array or an array of small horns. The array feed is relatively small compared to the reflector. The array feed has a plurality of feeds that illuminate the reflector. Each of the feeds includes a plurality of radiators and a power division network that excites each radiator of the respective feeds.

The radiators of each feed cluster may be disposed in a square or rectangular pattern. The radiators are disposed in a focal plane of the reflector. Each individual array feed is used for each respective beam position. Excitation coefficients used for each array feed, which correspond to different secondary beams from the reflector, may be different.

The excitation coefficients used for each array feed may be fixed prior to launching the spacecraft into orbit. Alternatively, the excitation coefficients may be variable to tune interbeam isolation. The excitation coefficients may be varied by adjusting the amplitude and phase coefficients while the spacecraft is in orbit using variable phase shifters and variable power dividers.

The antenna system is capable of very wide scan angle operation. The phase aberration normally associated with scanning is corrected by adjusting the excitation coefficients of each array feed. An antenna configuration that would normally be suitable for narrow angle scanning, such as regional coverage of a single country, for example, can therefore be used to provide multiple spot beam coverage over the surface of the Earth viewed from a synchronous orbit spacecraft.

In implementing an exemplary method, a spacecraft is launched into orbit that carries a communication system having a multiple beam antenna system. The multiple beam antenna system includes a reflector and the array feed having a plurality of radiators coupled to the communication system by way of a power division network. For optimum performance with the antenna system is operated at two frequency bands (such as a transmit band and a receive band), a frequency selective surface (FSS) may be used to allow individual optimization of two different feed arrays, for the two different operating bands.

Use of the frequency selective surface provides an efficient interface between the transmit feed arrays and power amplifiers that drive them. Use of the frequency selective surface allows the transmit feed arrays to be located relatively close to the power amplifiers. Therefore, relatively short waveguide transmission lines are used between the power amplifiers and the transmit feed arrays. More power is delivered to the transmit feed arrays and less loss is experienced by the communications system.

During transmission, RF energy is coupled from the communication system by way of the power division network to the radiators of the respective feeds to excite each of radiators. Energy radiated by the radiators is reflected by the reflector to produce multiple spot beams. The spot beams are scanned across a field of regard by controlling the position of each array feed in the focal plane and using the appropriate the amplitude and phase distribution associated with a particular spot beam (array feed).

Controlling the amplitude and phase distributions produced by the radiators allows different focal plane distributions to be realized for different scan positions to optimize the beamshapes generated by the multiple beam antenna system over a very wide coverage region. As was stated above, the amplitude and phase distribution associated with the respective array feed is typically fixed, although variable distributions may be implemented.

During reception, multiple spot beams are reflected by the reflector to the radiators of respective elements of the feeds. The RF energy contained in the multiple spot beams is coupled by way of the power combining network to the communication system.

Thus, the present invention uses a small array radiator for each individual feed in a multiple beam antenna system. One advantage of using a small array as the elemental radiator in a multiple beam antenna is that it provides for control of the amplitude and phase distribution within the focal plane cell that corresponds to a radiated beam from the multiple beam antenna. The use of the small array allows different distributions to be realized for different scan positions which optimizes the beamshapes generated by the multiple beam antenna over a very wide coverage region.

BRIEF DESCRIPTION OF THE DRAWINGS

The various features and advantages of the present invention may be more readily understood with reference to the following detailed description taken in conjunction with the accompanying drawings, wherein like reference numerals designate like structural elements, and in which.

DETAILED DESCRIPTION

Figure 1:
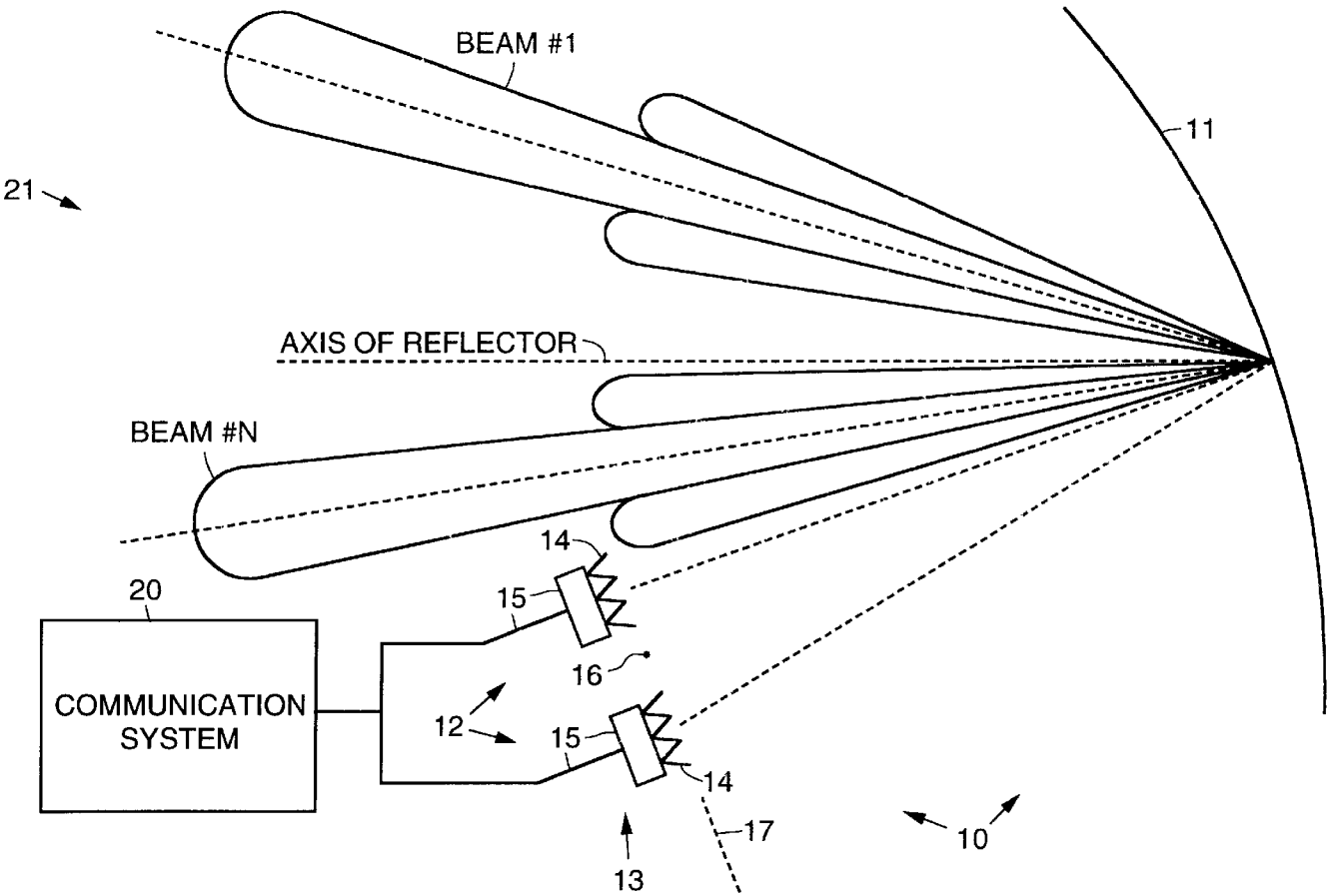
FIG. 1 illustrates a side view of an exemplary embodiment of a single operating band multiple beam antenna system in accordance with the principles of the present invention.
Figure 2:
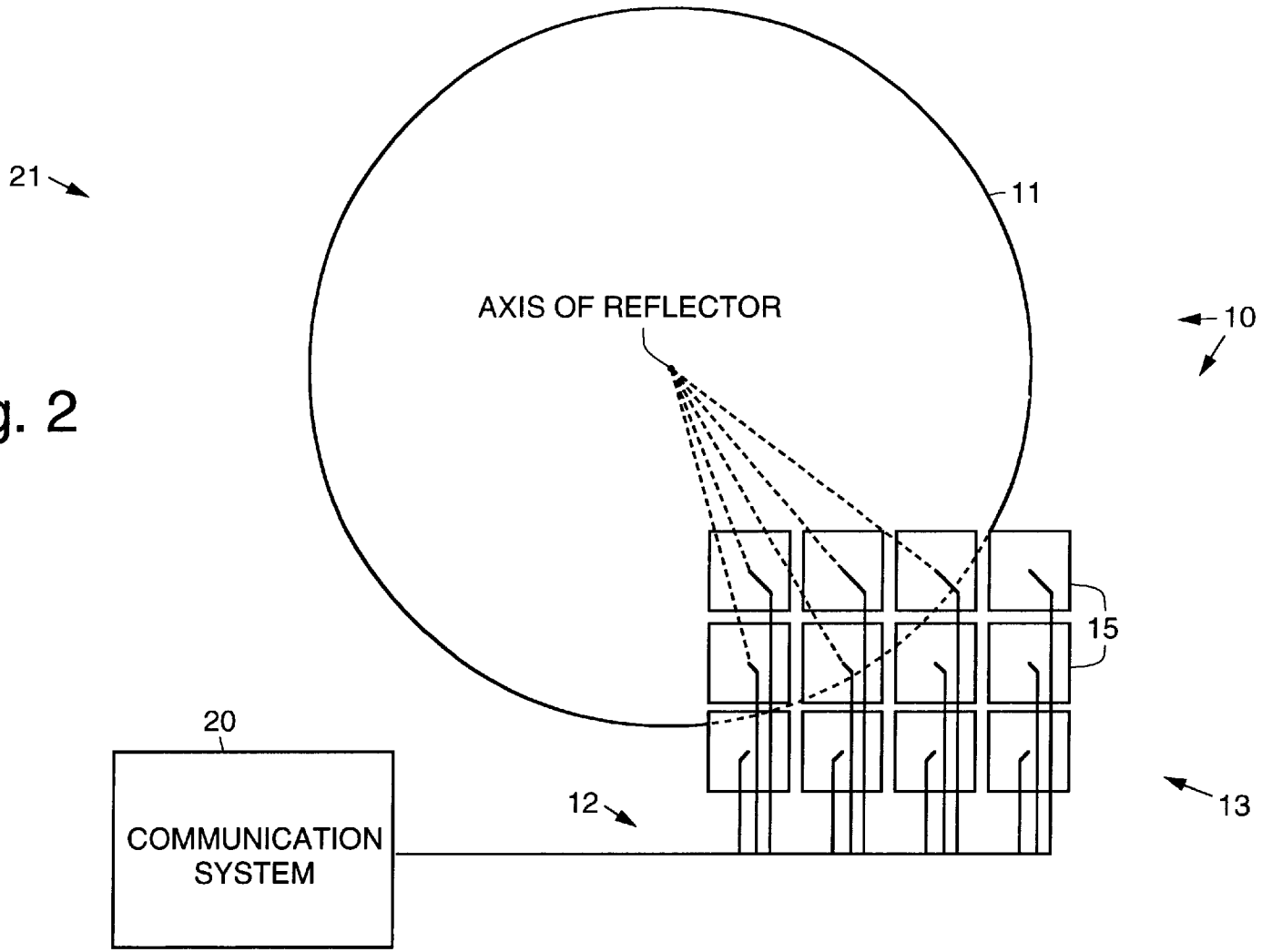
FIG. 2 is a front view of the antenna system of FIG. 1.

Referring to the drawing figures, FIG. 1 illustrates a side view of an exemplary embodiment of a single band multiple beam antenna system 10 in accordance with the principles of the present invention. FIG. 2 is a front view of the antenna system 10 of FIG. 1.

The multiple beam antenna system 10 is designed for use with a communication system 20 disposed on a spacecraft 21 (generally designated). FIG. 1 illustrates one possible implementation of an array feed 12 for the single band multiple beam antenna system 10.

More particularly, the multiple beam antenna system 10 comprises a reflector 11 and the array feed 12, which is relatively small compared to the reflector. The array feed 12 includes a plurality of feeds 13 that illuminate the reflector 11. Each of the feeds 13 comprises a plurality of radiators 14 and a power division network 15 that excites each of the radiators 14 of the respective feeds 13.

The radiators 14 of each the feeds 13 are arranged in a generally square or rectangular or triangular grid pattern. The radiators 14 of each the feeds 13 are disposed at the focal plane 17 of the reflector 11. A focal point of the reflector 11 is shown for clarity along with a line that represents the focal plane 17 of the reflector 11.

Thus, in the multiple beam antenna system 10, a small array feed 13 is disposed in the focal plane of the reflector 11 and is used for each beam position. Excitation coefficients used for each array feed 12 may be different. The implementation shown in FIG. 1 illustrates a waveguide slot array 12 as the feed array 12. However, it is to be understood that a variety of different types of feed arrays 12, such as circular or pyramidal horns, for example, may be used in the multiple beam antenna system 10.

The waveguide slot array 12 was selected as a preferred embodiment of the array feed 12 of the antenna system 10. The power division network 15 that excites slots of the waveguide slot array 12 is a low loss integral part of the waveguide slot array 14. This provides a composite array feed 12 and network 15 that is realized in a small lightweight package, which is also desirable from a spacecraft configuration standpoint. For the case where the array 12 is comprised of horn radiators, an external power division network 15 would be used.

FIGS. 1 and 2 show the array feed 12 (waveguide slot array 12) illuminating a single offset reflector 11. The configuration of this antenna system 10 is capable of very wide scan angle operation. The phase aberration normally associated with scanning is corrected by adjusting the excitation coefficients of each array feed 12. Proper adjustment of the excitation coefficients of each array feed 12 thus corrects errors associated with the scanned beam. An antenna configuration that would only be suitable for narrow angle scanning, such as regional coverage of a single country, for example, can therefore used to provide multiple spot beam coverage over the surface of the Earth viewed from a synchronous orbit spacecraft 21.

The excitation coefficients used for each array feed 12 may be fixed prior to launching the spacecraft 21 into orbit. Alternatively, the excitation coefficients may be variable to tune interbeam isolation. The excitation coefficients may be varied by adjusting the amplitude and phase coefficients while the spacecraft 21 is in orbit by controlling variable phase shifters and variable power dividers in a conventional manner. This will be beneficial to optimize beams with heavy communication traffic which is not known prior to the launch of the spacecraft 21.

Figure 3:
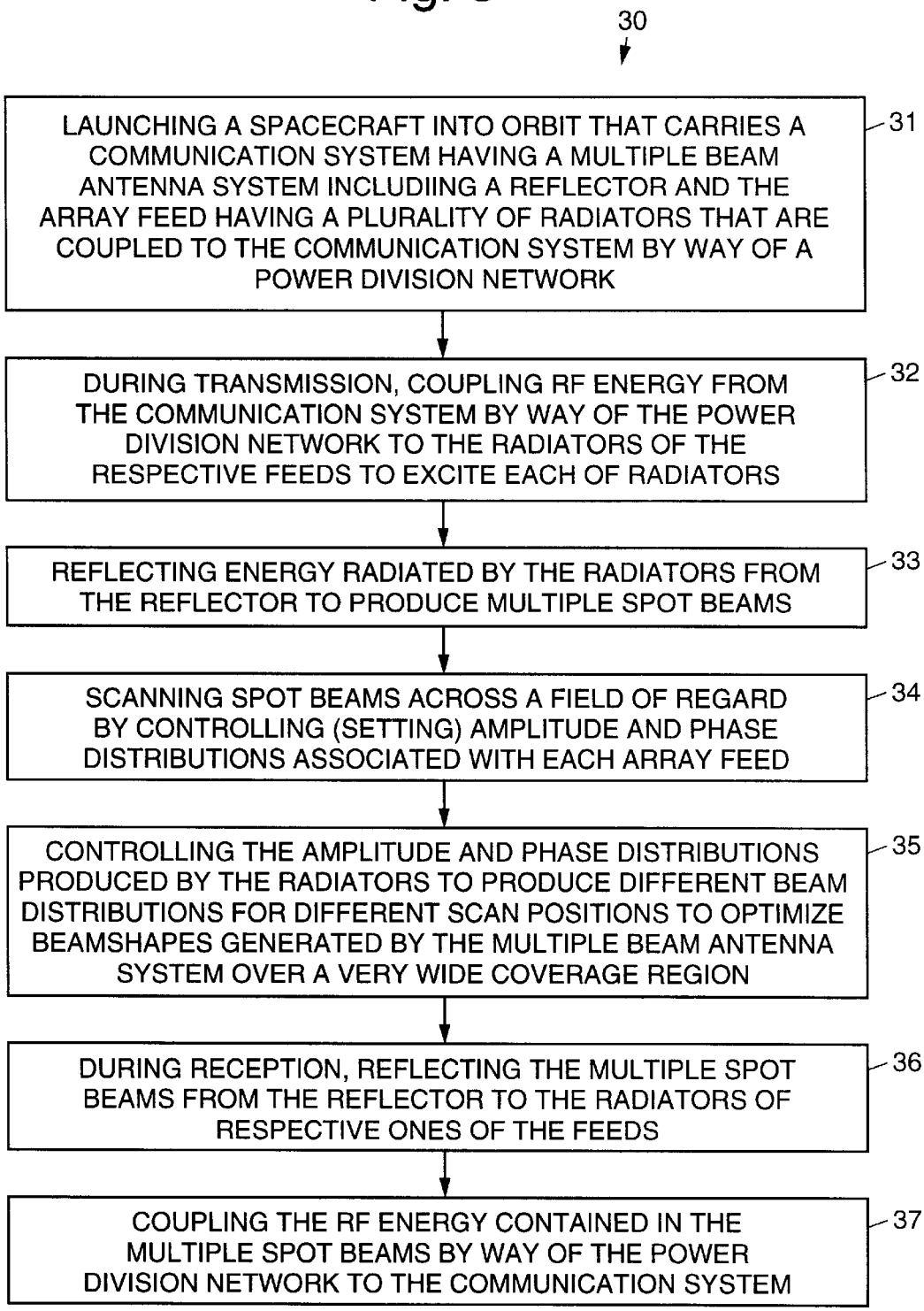
FIG. 3 is a flow chart that illustrates an exemplary method in accordance with the principles of the present invention for generating multiple spot beams for communication.

Referring now to FIG. 3, it is a flow chart that illustrates an exemplary method 30 in accordance with the principles of the present invention for generating multiple spot beams for communication. The method 30 comprises the following steps. A spacecraft 21 is launched 31 into orbit that carries a communication system 20 having a multiple beam antenna system 10 including a reflector 11 and an array feed 12 having a plurality of radiators 14 that are coupled to the communication system 20 by way of a power division network 15.

During transmission, RF energy is coupled 32 from the communication system 20 by way of the power division network 15 to the radiators 14 of the respective feeds 13 to excite each of radiators 14. Energy radiated by the radiators 14 is reflected 33 the reflector 11 to produce multiple spot beams. The spot beams are scanned 34 across a field of regard by appropriate positioning the feed array and radiator controlling (setting or fixing) the amplitude and phase distribution associated with a particular spot beam (i.e., each array feed 12). In a typical implementation, the amplitude and phase distribution associated with each respective array feed 12 is fixed. Controlling 35 the amplitude and phase distributions produced by the radiators 14 allows different beam distributions to be realized for different scan positions to optimize the beamshapes generated by the multiple beam antenna system 10 over a very wide coverage region.

Figure 4:
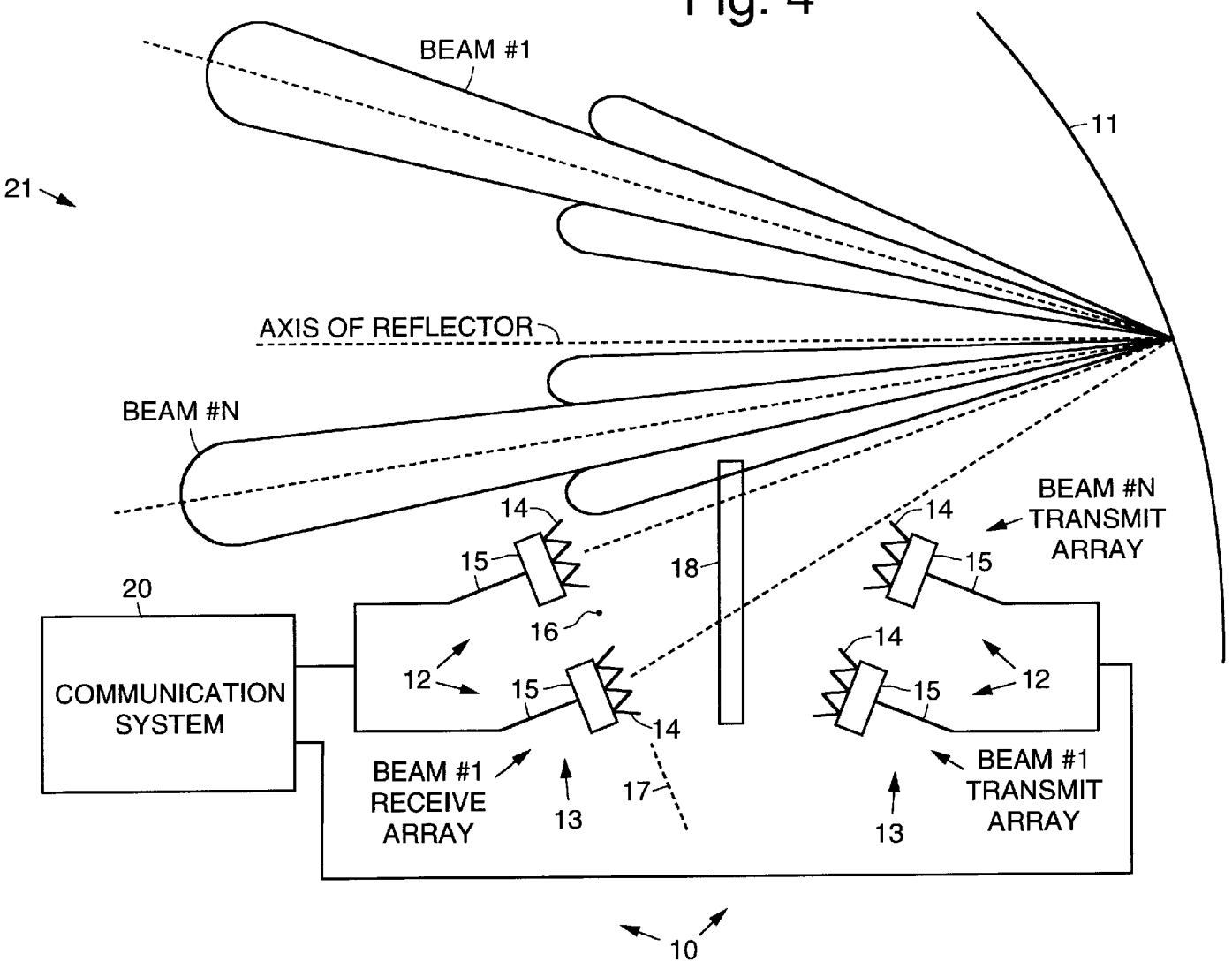
FIG. 4 illustrates a side view of an exemplary embodiment of a dual band multiple beam antenna system in accordance with the principles of the present invention.

During reception, multiple spot beams are reflected 36 by the reflector 11 to the radiators 14 of respective elements of the feeds 13. The RF energy contained in the multiple spot beam, is coupled 37 by way of the power division network 15 to the communication system 20. Referring now to FIG. 4, it illustrates a side view of an exemplary embodiment of a dual band multiple beam antenna system 10 in accordance with the principles of the present invention. For optimum performance of both the transmit operating band and the receive operating band, a frequency selective surface (FSS) 18 such as is shown in FIG. 4 may be used to permit the use of separate array feeds 12 in the multiple beam antenna system 10. The coefficients of the transmit and receive array feeds 12 may then be individually optimized. The frequency selective surface 18 operates to optimally couple energy in transmit and receive frequency bands to respective transmit and receive array feeds 12.

Use of the frequency selective surface 18 also provides a very efficient interface between the transmit feed arrays 12 and power amplifiers that drive them. Using the frequency selective surface 18 allows the transmit feed arrays 12 to be located relatively close to the power amplifiers. This permits relatively short waveguide transmission lines between the power amplifiers and the transmit feed arrays 12. Thus, more power is delivered to the transmit feed arrays 12 and there is less loss experienced by the communications system 20.

Thus, multiple beam antenna systems and methods for use in spacecraft communication systems have been disclosed. It is to be understood that the above-described embodiments are merely illustrative of some of the many specific embodiments that represent applications of the principles of the present invention. Clearly, numerous and other arrangements can be readily devised by those skilled in the art without departing from the scope of the invention.

What is claimed is:

1. A dual band antenna system use on a spacecraft having a communication system comprising:

a reflector;

a first two-dimensional array feed that is relatively small compared to the size of the reflector;

a second two-dimensional array feed that is relatively small compared to the size of the reflector;

a power division network coupled between the communication system and the first and second array feeds; and a frequency selective surface disposed between the first and second array feeds.

2. The antenna system recited in claim 1 wherein the array feed comprises a plurality of feeds that illuminate the reflector.

3. The antenna system recited in claim 2 wherein the each of the feeds comprises a plurality of radiators.

4. The antenna system recited in claim 3 wherein the power division network excites each of the radiators of the feeds.

5. The antenna system recited in claim 3 wherein the radiators of each the feeds are arranged in a square grid pattern.

6. The antenna system recited in claim 3 wherein the radiators of each the feeds are arranged in a rectangular grid pattern.

7. The antenna system recited in claim 3 wherein the radiators of each the feeds are arranged in a triangular grid pattern.

8. The antenna system recited in claim 3 wherein the radiators of each the feeds are disposed in a focal plane of the reflector.

9. The antenna system recited in claim 1 wherein the feed array comprises a waveguide slot array.

10. The antenna system recited in claim 1 wherein the reflector comprises an offset reflector.

11. The antenna system recited in claim 1 wherein spot beams are scanned across a field of regard by appropriate positioning if the feed array in the focal plane and the sidelobes of each beam are optimized for interbeam isolation by controlling amplitude and phase distributions associated with each array feed.

12. The antenna system recited in claim 1 wherein amplitude and phase distributions associated with each array feed are fixed.

13. The antenna system recited in claim 1 wherein amplitude and phase distributions associated with each array feed are variable.

14. A method of Generating multiple spot beams comprising the steps of:

launching a spacecraft into orbit that carries a communication system having a multiple beam antenna system including a reflector and first and second two-dimensional array feeds each having a plurality of radiators that are coupled to the communication system by way of a power division network, and a frequency selective surface disposed between the first and second array feeds;

during transmission, coupling RF energy from the communication system by way of the power division network to the radiators of the respective feeds of one of the two-dimensional array feeds to excite each of the radiators thereof;

reflecting energy radiated by the radiators of the one of the two-dimensional array feeds from the reflector to produce multiple spot beams;

during reception, reflecting the multiple spot beams from the reflector to the radiators of the feeds of the other two-dimensional array feed using the frequency selective surface; and coupling the RF energy contained in the multiple spot beams by way of the power division network to the communication system.

15. The method recited in claim 14 wherein spot beams are scanned across a field of regard by array position, and performance is optimized by controlling amplitude and phase distributions associated with each array feed.

16. The method recited in claim 14 wherein amplitude and phase distributions associated with each array feed are fixed.

17. The method recited in claim 14 wherein amplitude and phase distributions associated with each array feed are variable.

18. The method recited in claim 14 wherein the amplitude and phase distributions produced by the radiators are controlled to produce different beam distributions for different scan positions to optimize beamshapes generated by the multiple beam antenna system over a very wide coverage region.

* * * * *